US009758999B2

(12) United States Patent
Heth

(10) Patent No.: US 9,758,999 B2
(45) Date of Patent: Sep. 12, 2017

(54) ROTOR AND STATOR DESIGN WITH PERMANENT MAGNETS

(71) Applicant: Joey Erwin Heth, Cleveland, OH (US)

(72) Inventor: Joey Erwin Heth, Cleveland, OH (US)

( * ) Notice: Subject to any disclaimer, the term of this patent is extended or adjusted under 35 U.S.C. 154(b) by 78 days.

(21) Appl. No.: 14/286,114

(22) Filed: May 23, 2014

(65) Prior Publication Data

US 2014/0345086 A1 Nov. 27, 2014

Related U.S. Application Data

(60) Provisional application No. 61/855,786, filed on May 23, 2013.

(51) Int. Cl.
*E05D 11/10* (2006.01)
*E05D 3/02* (2006.01)

(52) U.S. Cl.
CPC ..... *E05D 11/1014* (2013.01); *E05D 3/02* (2013.01); *E05Y 2201/246* (2013.01); *Y10T 16/5401* (2015.01)

(58) Field of Classification Search
CPC .. E05D 11/1014; E05D 3/02; E05Y 2201/246
See application file for complete search history.

(56) References Cited

U.S. PATENT DOCUMENTS 4,614,225 A * 9/1986 Ernst ..... B22D 11/115 164/421
RE36,367 E * 11/1999 Nagate ..... H02K 1/2746 310/152
6,244,835 B1 * 6/2001 Antaki ..... A61M 1/101 415/900
6,630,878 B2 * 10/2003 Pan ..... H04M 1/0216 335/285
6,823,561 B2 * 11/2004 Park ..... E05F 3/00 16/320
6,906,443 B2 * 6/2005 Luo ..... H02K 1/278 310/156.47
2003/0179880 A1 * 9/2003 Pan ..... H04M 1/0216 379/433.13
2007/0052312 A1 3/2007 Stanetskiy et al.
(Continued)

FOREIGN PATENT DOCUMENTS

JP 2005295774 A * 10/2005

*Primary Examiner* — Victor Batson
*Assistant Examiner* — Matthew Sullivan
(74) *Attorney, Agent, or Firm* — Fay Sharpe LLP; James E. Scarbrough

(57) ABSTRACT

Provided is a magnetic hinge device including a rotor having an elongated body with a rotor surface at least one permanent rotor magnet coupled to the rotor surface. A stator including an inner surface that defines a cavity to receive the rotor, the rotor is positioned within the stator along a common axis of rotation. The inner surface of the stator is generally radially continuous having a first edge portion and a second edge portion such that the first edge portion is attached to the second edge portion at an offset. The stator having at least one permanent stator magnet coupled to the inner surface. The rotor includes a radial position that is configured to rotate to a neutral position within the stator. The neutral position along the common axis of rotation is in approximate alignment with the offset.

19 Claims, 4 Drawing Sheets

(56) References Cited

U.S. PATENT DOCUMENTS

| | | | | |
|---|---|---|---|---|
| 2007/0077971 | A1* | 4/2007 | Tu | H04M 1/0216 455/575.3 |
| 2007/0077972 | A1* | 4/2007 | Tu | H04M 1/0216 455/575.3 |
| 2012/0049663 | A1* | 3/2012 | Mishra | H01F 1/083 310/44 |
| 2013/0106207 | A1 | 5/2013 | Song et al. | |

* cited by examiner

ROTOR AND STATOR DESIGN WITH PERMANENT MAGNETS

This application claims priority from and the benefit of U.S. Provisional Patent Application Ser. No. 61/855,786 filed May 23, 2013, the entirety of which is hereby incorporated by reference.

BACKGROUND

The present exemplary embodiment relates to rotor and stator design with permanent magnets. It finds particular application in conjunction with use as a rotable hinge, and will be described with particular reference thereto. However, it is to be appreciated that the present exemplary embodiment is also amenable to other like applications.

It is known that permanent magnets are widely used in the construction of electromagnetic generators and electric motors. In these instances, the known constructions include various designs of rotors and stators having an arrangement of permanent magnets attached to the rotor or the stator in a fashion that helps to create rotable torque of the rotor relative to the stator.

For example, U.S. Pat. Pub. No. 2007/0052312 to Stanetskiy et al. discloses a permanent magnet motor having stator and rotor assemblies that utilizes permanent magnets that are spaced apart with iron inserts and conformed into annular segmented shapes of a three-dimensional spiral positioned between the rotor and stator. Additionally, most rotor and stator devices are provided with a stator having an inner surface that defines a hollow cavity for receiving the rotor. The inner surface has a generally circular orientation to allow the rotor to rotate freely therein.

However, it would be desirable to provide a magnetic rotor and stator hinge device that reduces friction by utilizing magnetic forces for creating torque and that can be attached to or integrated with a variety of doors or rotable applications that are conditioned to return to a neutral position. It is also desirable to provide a magnetic device that connects and secures adjacent components while allowing for complete 360 degree rotational movement of the components with respect to each other that is conditioned to return to a neutral position.

BRIEF DESCRIPTION

In one embodiment, provided is a magnetic hinge device including a rotor having an elongated body with a rotor surface at least one permanent rotor magnet coupled to the rotor surface. A stator including an inner surface that defines a cavity to receive the rotor, the rotor is positioned within the stator along a common axis of rotation. The inner surface of the stator being generally radially continuous having a first edge portion and a second edge portion such that the first edge portion is attached to the second edge portion at an offset. The stator having at least one permanent stator magnet coupled to the inner surface. The rotor includes a radial position that is configured to rotate to a neutral position within the stator. The neutral position along the common axis of rotation in approximate alignment with the offset.

In another embodiment, disclosed is a magnetic hinge device that includes a rotor having an elongated body with a rotor surface having at least one permanent rotor magnet coupled to the rotor surface at a radial position. The rotor is aligned within at least one stator having an inner surface that defines a cavity to receive the rotor. The rotor is positioned within the stator along a common axis of rotation. The inner surface having a generally continuous profile with an offset that includes a first edge portion and a second edge portion such that the first edge portion is aligned to the second edge portion. The stator having at least one permanent stator magnet coupled to the inner surface. A housing rotably supports the rotor within the stator and includes at least two bearings wherein the at least two bearings rotably support the rotor within the stator along the common axis of rotation wherein as the rotor is rotated about the axis of rotation, the radial position of the rotor is configured to rotate to a neutral position within the stator. The radial position of the rotor is in approximate alignment with the offset of the inner surface in the neutral position.

The permanent rotor magnet is rotated a first amount by an external force that moves the permanent rotor magnet away from the offset towards the inner surface that extends from the first edge portion such that a magnetic torque rotates the rotor about the common axis to return to the neutral position. In one embodiment, the first amount is between about 20 degrees to about 60 degrees such that the magnetic torque rotates the rotor about the common axis to return to the neutral position. Prefereably, the first amount is about 30 degrees.

DETAILED DESCRIPTION

Figure 1:
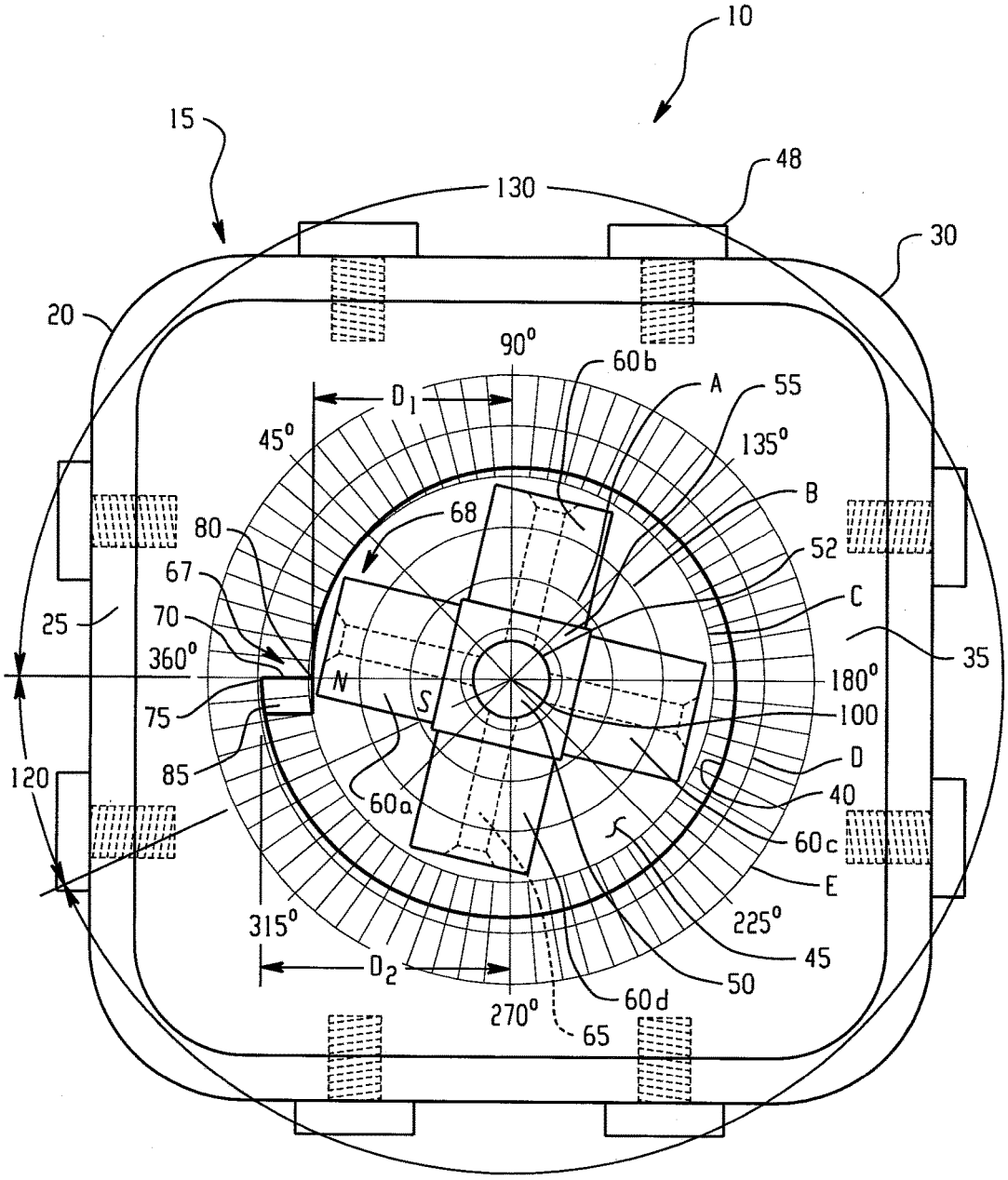
FIG. 1 is a plan view of one embodiment of the rotor and stator assembly of the present disclosure.
Figure 4:
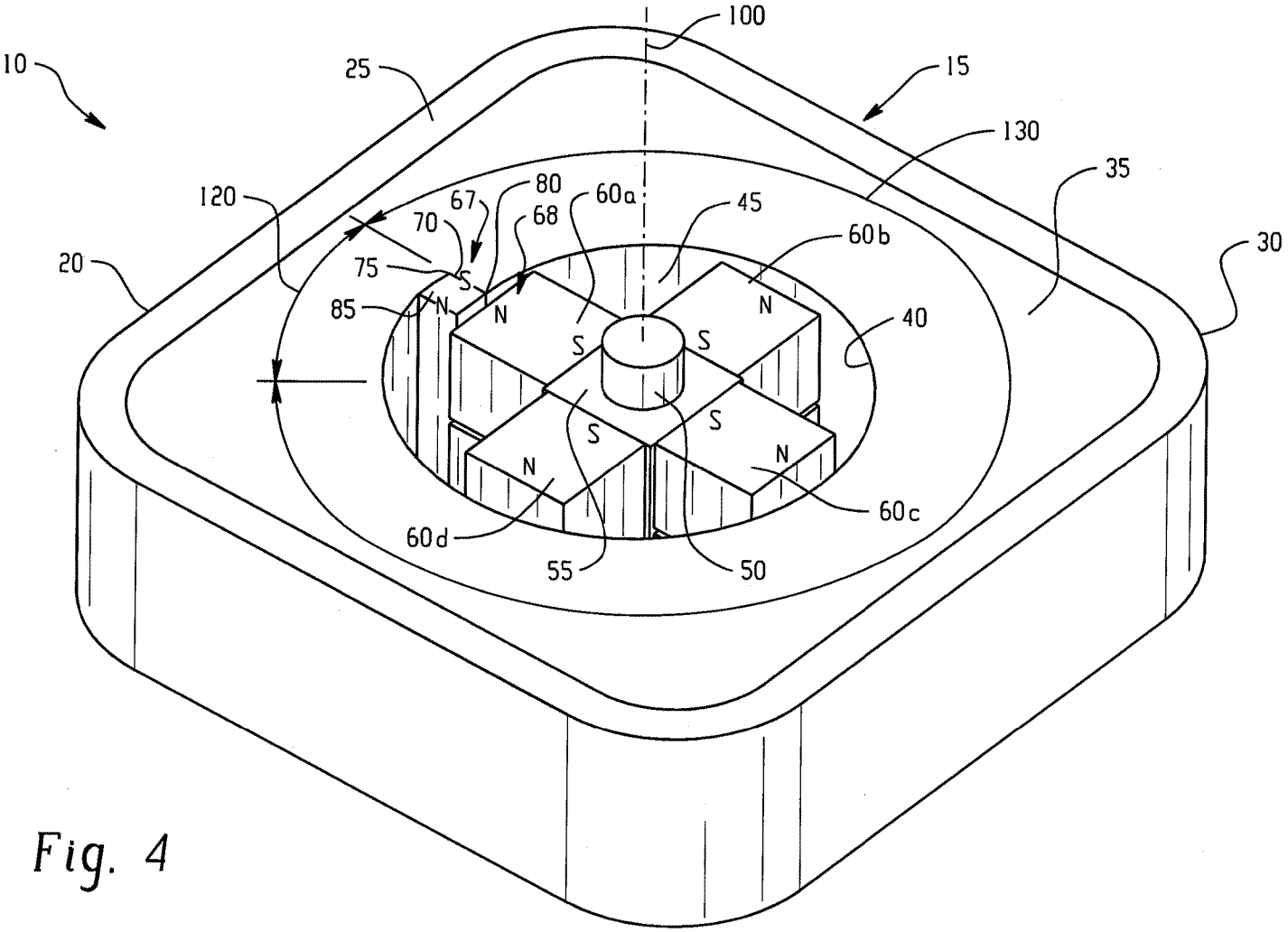
FIG. 4 is a perspective view of the rotor and stator assembly of FIG. 1.

With reference to FIGS. 1 and 4, illustrated is one embodiment a rotor and stator assembly 10 of the current disclosure. The assembly 10 is particularly useful as a magnetic hinge device that requires rotation from an external force and a return to a neutral position. The assembly 10 includes a stator 15 having a housing 20 with a generally square shaped outer body 25 with rounded edges 30. The stator 15 includes an inner portion 35 having an inner surface 40. The inner surface 40 having a generally continuous profile that defines an inner cavity 45. In one embodiment, the inner portion 35 is a continuous body in which a bore hole is drilled to create the contours of the inner surface 40 and the inner cavity 45. Alternatively, the inner portion 35 could be a plurality of sections so long as the inner cavity 45 is defined by the inner surface 40 having a generally continuous profile. The stator 35 is made of a ferromagnetic material. The outer body 25 is attached to the inner portion 35 of the stator 35 by a plurality of conventional fasteners 48.

A rotor 50 is provided within the inner cavity 45 of the stator 15. The rotor 50 and the stator 15 align along a common axis of rotation 100. The rotor includes a platform member 55 that is attached to a rotor surface 52. In one embodiment, the platform member 55 has a generally square cross sectional shape with four platforms and a threaded inner surface. The rotor 50 is threadingly attached to the platform member 55. However, the platform member 55 could be attached to the rotor 50 by adhesives, fasteners or other known methods.

At least one permanent rotor magnet 60 is attached to the rotor 50. In one embodiment, a plurality of magnets 60*a*, 60*b*, 60*c*, 60*d* are attached to the platform member 55 and radially extend from the rotor 50. The magnets 60 are permanent type magnets and are not powered by electrical means. In one embodiment, the magnets are neodymium type magnets that have various magnetic flux ratings and in particular range between N35-N52. The plurality of magnets 60*a*-60*d* are each attached to the four platforms of the platform member 55 by conventional fasteners 65. As illustrated by FIG. 1, magnet 60*a* is attached to the rotor 50 at a radial position 68 that is positioned in the neutral position 67 in alignment with an offset 70 and the stator magnet 85.

The inner surface 40 of the stator 15 has a generally continuous profile shape that includes the offset or step 70. The offset 70 is positioned between a first edge portion 75 and a second edge portion 80 of the inner surface 40. The first edge portion 75 is radially spaced a first distance $D_1$ from the axis of rotation 100. The second edge portion 80 is radially spaced a second distance $D_2$ from the axis of rotation 100 wherein the first distance $D_1$ is greater than the second distance $D_2$. In one embodiment, as illustrated by FIGS. 1 and 4, the offset 70 is aligned generally perpendicular between the first edge portion 75 and the second edge portion 80.

In the embodiment of FIG. 1, a permanent stator magnet 85 is provided within the stator 15 and coupled to the inner surface 40 at a position adjacent the offset 70. In this embodiment, the stator magnet 85 is a generally rectangular shaped body that is attached between the first edge portion 75 and the second edge portion 80 of the inner surface 40. The magnet 85 is a neodymium type magnet that can have various magnetic flux ratings and in particular range between N35-N52.

Additionally, FIG. 1 includes indicia of a circle graph identifying various degrees about the stator 15 to illustrate the contour of the inner surface 40 of the stator 15 relative to the rotor 50. The circle graph has an origin that is aligned with the common axis of rotation 100 and five concentric circles A, B, C, D and E that radially extend from the axis 100. In this embodiment, the offset 70 is near the 360° mark and the concentric circles assist to identify the generally continuous profile contour of the inner surface 40 as it extends from the first edge portion 75 about the rotor 50 to the second edge portion 80. The first edge portion 75 of the offset 40 is adjacent the fourth concentric circle D and the second edge portion 80 is adjacent the third concentric circle C. The inner surface 40 near 90° is positioned adjacent the third concentric circle C and is between circles C and D. At 180°, the inner surface 40 is closer to circle D and at 270° is adjacent to circle D. This illustration assists to disclose that inner surface 40 is continuously reducing the space of the inner surface 40 relative to the common axis of rotation 100 from the first edge portion 75 to the second edge portion 80.

Figure 2:
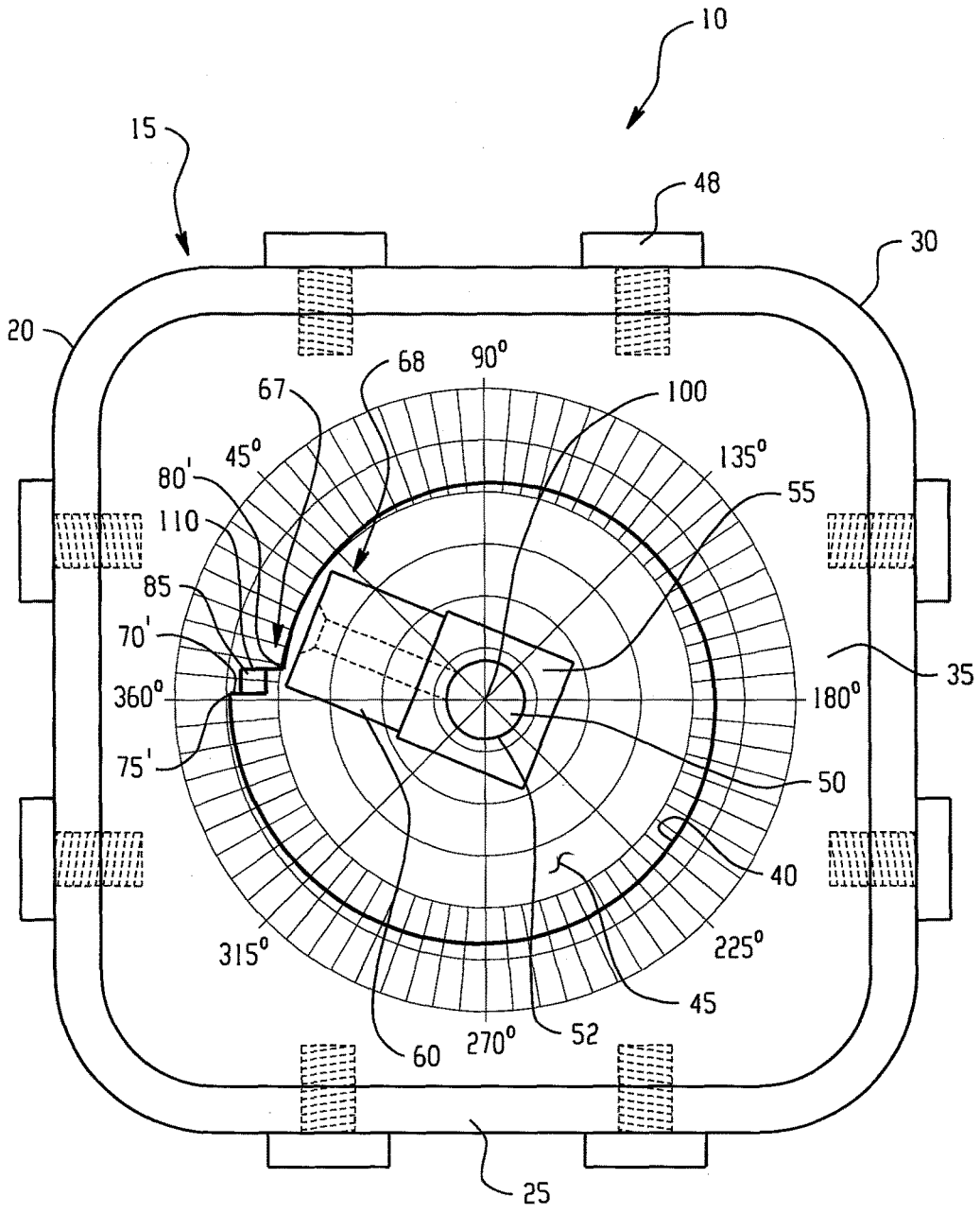
FIG. 2 is a plan view of another embodiment of the rotor and stator assembly of the present disclosure.

With reference to FIG. 2, illustrated is an alternate embodiment of the present disclosure. The rotor 50 includes one permanent rotor magnet 60 as it is positioned in the neutral position 67 in alignment with the offset 70. In this embodiment, the offset 70 includes a notch 110 to support the permanent stator magnet 85 therein. The notch 110 is between a first edge portion 75' and a second edge portion 80' of the inner surface 40.

In one embodiment, the permanent stator magnet 85 is a N52 type magnet and the permanent rotor magnet 60 is a N52 type magnet. However, various combinations of permanent magnets are contemplated. As the rotor 50 is rotated in a counterclockwise direction relative to FIGS. 1 and 2, the permanent rotor magnet 60, 60*a* is rotated a first amount 120 moving the permanent rotor magnet 60*a* away from the offset 70 towards the inner surface 40 that extends from the first edge portion 75. The configuration of the stator 15, having the generally continuous inner surface 40 with continuously reducing cavity 45 between the first edge portion 75 and the second edge portion 80 creates a magnetic torque that rotates the rotor 50 the remaining length 130 of one full rotation about the common axis 100 to return the radial position 68 of the rotor 50 to the neutral position 67. In this embodiment, the first amount is a threshold amount, wherein if the rotor 50 is rotated less than the first amount 120, the radial position 68 of the rotor 50 will magnetically attract back to the neutral position 67 without completing a full rotation.

The permanent stator magnet 85 and the permanent rotor magnets 60 have a polar arrangement in which the stator magnet 85 has a south pole S positioned against the offset 70 and the north pole N positioned towards the cavity 45. The rotor magnet 60 has a south pole S positioned against the platform 55 and the north pole N positioned towards the inner surface 40. This polar arrangement assists to produce the desired magnetic torque force required to assist the continued rotation of the rotor 50 after it has been rotated the first amount 120 from the neutral position 67. Consequently, the opposite polarity of the rotor and stator magnets could be utilized so long as the opposing polarities of the rotor magnet 60 and the stator magnet 85 is maintained in a generally perpendicular relationship as illustrated.

Figure 3:
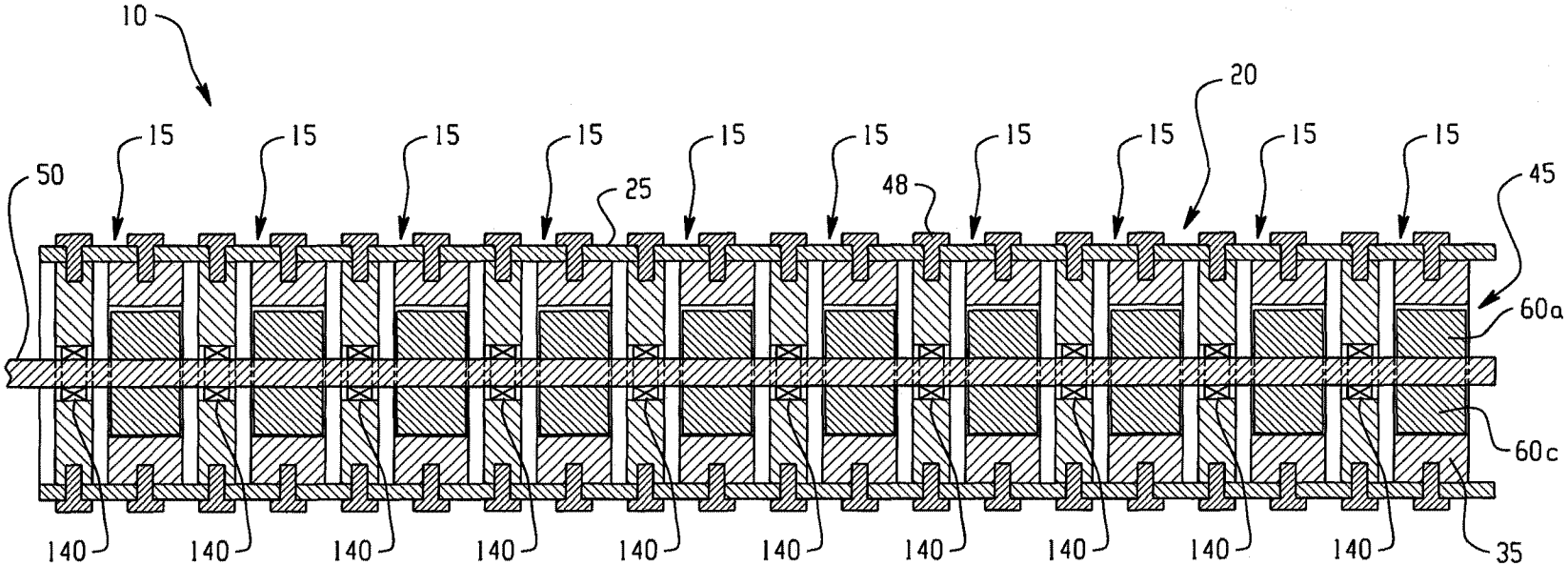
FIG. 3 is a cross sectional view of one embodiment of the rotor and stator assembly of the present disclosure with a plurality of aligned stators within a housing.

In one embodiment, the first amount is about 20° such that the magnetic torque rotates the rotor about 340° without an associated rotable force or assistance to return the radial position 68 of the rotor 50 to the neutral position 67 aligned with the offset 70. The first amount 120 can vary depending on any external load that is attached to the rotor 50, however, the magnetic torque force can be adjusted based on the strength and quantity of the permanent magnets 60 used and the length and quantity of stators 15. As such, multiple stators 15 can be utilized and coupled along one rotor 50 having a plurality of magnets 60 attached to the rotor 50 and in alignment to increase the magnetic torque force as necessary relative to the amount of rotable load attached to the rotor 50. FIG. 3 illustrates one embodiment, in which nine stators 15 are aligned along the rotor 50. The stators 15 each include the inner surface 40 as illustrated by FIG. 1. The offsets 70 of each stator 15 are in axial alignment. The housing 20 supports the stator 15 within a cavity and includes at least two bearings 140. The stator 15 and rotor 50 are supported within the housing such that the bearings 140 rotably support the rotor 50 within the stators 15 along the common axis of rotation 100. In the embodiment of FIG. 3, ten bearings 140 support the rotor 50 within the housing 20.

Additionally, the rotor 50 can be rotated in a clockwise direction relative to FIGS. 1 and 2 with different results. In particular, as the rotor 50 is rotated a second amount 140, an opposite direction of the first amount 120, the permanent rotor magnet 60, 60*a* is moved away from the offset 70 towards the inner surface 40 that extends from the second edge portion 80. In this instance, the magnetic torque is generated to rotate the rotor 50 about the common axis 100 to return the radial position to the neutral position 67. However, in this instance, the second amount is much greater than the first amount. The second amount is between about 270° to about 340° relative to the offset in the clockwise direction. In one embodiment, the second amount is about 330° such that the magnetic torque rotates the rotor the remaining 30° about the common axis 100 in the clockwise direction to return to the radial portion 68 to the neutral position 67. However, if the rotor 50 is merely rotated an amount less than the threshold second amount, then the radial portion 68 of the rotor 50 will rotate back to the neutral position 67 without making a full rotation about the common axis 100 in the clockwise direction.

This configuration is preferable when the assembly 10 is attached to a system having a load that is required to rotate completely about the common axis of rotation 100 in which a slight amount of force is required in one direction (counterclockwise) to move the rotor from alignment with the offset 70. This assembly 10 would prevent the rotor from rotating a full 360° in the opposite direction (clockwise) unless the amount of force is relatively continuously applied to rotate the rotor in the opposite direction to move the radial position 68 the threshold second amount.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A magnetic hinge device comprising:

a rotor having an elongated body with a rotor surface and a plurality of permanent rotor magnets coupled to the rotor surface, the rotor magnets are substantially square shaped and oriented and spaced apart forming a gap between each rotor magnet wherein there is no contact between said rotor magnets; and a stator including an inner surface that defines a stator cavity to receive the rotor, the rotor positioned within the stator along a common axis of rotation, and the stator having one or more permanent stator magnets coupled to the inner surface;

wherein the rotor is configured to rotate to a neutral position within the stator cavity in alignment with the one or more permanent stator magnets; and wherein the stator cavity has an inside diameter extending through the common axis of rotation and the inside diameter continually reduces within the stator cavity in a counter-clockwise rotational direction from a first point at the neutral position over 360 degrees about the common axis of rotation to a second point at the neutral position, wherein the first point is spaced a first distance from the common axis of rotation and the second point is spaced a second distance from the common axis of rotation, the first distance being greater than the second distance.

2. The magnetic device of claim 1 further comprising a housing including a housing cavity and including at least two bearings wherein the stator and rotor are supported within the housing cavity such that the at least two bearings rotably support the rotor within the stator along the common axis of rotation.

3. The magnetic device of claim 2 wherein a plurality of stators are aligned along the common axis and positioned within the housing cavity.

4. The magnetic device of claim 1 wherein the rotor comprises at least four rotor permanent magnets radially spaced on the rotor surface of the rotor.

5. The magnetic device of claim 4 wherein the inner surface includes one or more notches to receive the one or more permanent stator magnets.

6. The magnetic device of claim 1 wherein said permanent rotor magnets and said one or more permanent stator magnets are magnetically aligned with an attracting magnetic force generated by opposite polarities of the permanent rotor magnets relative to said one or more permanent stator magnets.

7. A magnetic hinge device comprising:

a rotor having an elongated body with a rotor surface, and four a plurality of permanent substantially square shaped rotor magnets coupled to the rotor surface and positioned apart from each other forming a gap between each of adjacent magnets whereby said magnets do not contact each other;

at least one stator including an inner surface that defines a stator cavity to receive the rotor, the rotor is positioned within the stator along a common axis of rotation, the stator having at least one permanent stator magnet coupled to said inner surface;

a housing defining a housing cavity and including at least two bearings wherein the stator and rotor are supported within the cavity such that the at least two bearings rotably support the rotor within the stator along the common axis of rotation;

wherein a first position of the rotor is a neutral position within the stator, the neutral position is in alignment with the stator magnet;

wherein the stator cavity has an inside diameter extending through the common axis of rotation and the inside diameter continually reduces within the stator cavity in a counter-clockwise rotational direction from a first point at the neutral position over 360 degrees about the common axis of rotation to a second point at the neutral position, wherein the first point is spaced a first distance from the common axis of rotation and the second point is spaced a second distance from the common axis of rotation, the first distance being greater than the second distance.

8. The magnetic hinge device of claim 7 wherein the stator comprises ferromagnetic material.

9. The magnetic hinge device of claim 7 wherein the permanent stator magnet is a N52 type magnet.

10. The magnetic hinge device of claim 7 wherein each of said permanent rotor magnets are N52 type magnets.

11. The magnetic hinge device of claim 7 wherein when one of the permanent rotor magnets is rotated a first amount of rotation, said permanent rotor magnet moves away from the stator magnet such that a magnetic torque rotates the rotor about the common axis to return to the neutral position.

12. The magnetic hinge device of claim 11 wherein the first amount of rotation is in the range of about 20 degrees to about 90 degrees relative to the stator magnet such that the magnetic torque rotates the rotor about the common axis to return to the neutral position.

13. The magnetic hinge device of claim 11 wherein when one of the permanent rotor magnets is rotated a second amount of rotation which is less than the first amount of rotation, said permanent rotor magnet moves away from the stator magnet such that the magnetic torque attracts the rotor to return to the neutral position without rotating about the common axis.

14. The magnetic hinge device of claim 13 wherein the second amount of rotation has a range of about 270 degrees to about 340 degrees relative to the stator magnet such that the magnetic torque rotates the rotor about the common axis to return to the neutral position.

15. The magnetic device of claim 3 further comprising a plurality of sections each including a plurality of rotor magnets coupled to the rotor surface, wherein the plurality of sections are aligned along the common axis and positioned within the cavity of the housing.

16. The magnetic hinge device of claim 7 wherein a plurality of stators are aligned along the common axis and positioned within the housing cavity.

17. The magnetic hinge device of claim 16 further comprising a plurality of sections each including a plurality of rotor magnets coupled to the rotor surface, wherein the plurality of sections are aligned along the common axis and positioned within the housing cavity.

18. The magnetic device of claim 1 wherein each permanent rotor magnet of the plurality of permanent rotor magnets has a north or a south pole positioned near the rotor surface and an opposing north or south pole positioned toward the inner surface of the stator, and the polarity of the poles positioned near the rotor surface and the inner surface is the same for each permanent rotor magnet.

19. The magnetic hinge device of claim 7 wherein each permanent rotor magnet of the plurality of permanent rotor magnets has a north or a south pole positioned near the rotor surface and an opposing north or south pole positioned toward the inner surface of the stator, and the polarity of the poles positioned near the rotor surface and the inner surface is the same for each permanent rotor magnet.

* * * * *